US009334764B2

(12) United States Patent
Popp et al.

(10) Patent No.: US 9,334,764 B2
(45) Date of Patent: May 10, 2016

(54) VALVE GEAR FOR AN INTERNAL COMBUSTION ENGINE

(71) Applicant: Schaeffler Technologies AG & Co. KG, Herzogenaurach (DE)

(72) Inventors: Markus Popp, Bamberg (DE); Harald Elendt, Altendorf (DE); Jan Pfannenmuller, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/647,915

(22) PCT Filed: Nov. 7, 2013

(86) PCT No.: PCT/DE2013/200275

§ 371 (c)(1),
(2) Date: May 28, 2015

(87) PCT Pub. No.: WO2014/086351

PCT Pub. Date: Jun. 12, 2014

(65) Prior Publication Data

US 2015/0308302 A1 Oct. 29, 2015

(30) Foreign Application Priority Data

Dec. 4, 2012 (DE) ..... 10 2012 222 113

(51) Int. Cl.
*F01L 1/34* (2006.01)
*F01L 1/344* (2006.01)
*F01L 13/00* (2006.01)

(52) U.S. Cl.
CPC ..... *F01L 1/344* (2013.01); *F01L 13/0036* (2013.01)

(58) Field of Classification Search
CPC ..... F01L 1/344; F01L 13/0036
USPC ..... 123/90.16
See application file for complete search history.

(56) References Cited

U.S. PATENT DOCUMENTS

| | | | | |
|---|---|---|---|---|
| 8,584,639 | B2 | 11/2013 | Elendt et al. | |
| 2007/0034184 | A1 * | 2/2007 | Dengler | F01L 1/08 123/90.17 |
| 2007/0178731 | A1 | 8/2007 | Elendt | |
| 2010/0126445 | A1 | 5/2010 | Schiepp et al. | |

FOREIGN PATENT DOCUMENTS

| | | |
|---|---|---|
| DE | 102004024219 | 1/2006 |
| DE | 102007037232 | 2/2009 |
| DE | 102009009080 | 8/2010 |
| DE | 102009021650 | 11/2010 |
| DE | 102011001124 | 9/2012 |
| DE | 102011004912 | 9/2012 |
| WO | 2005080761 | 9/2005 |

* cited by examiner

*Primary Examiner* — Zelalem Eshete
(74) *Attorney, Agent, or Firm* — Volpe and Koenig, P.C.

(57) ABSTRACT

A sliding cam valve train for an internal combustion engine is provided. A cam piece (3) displaceably arranged on a carrier shaft (2) includes a cam group (4, 5) with differing cam lifts and an axial groove with two groove tracks (8, 9), which are arranged completely behind one another in the circumferential direction of the axial groove. An actuator pin (10) which may be introduced into the axial groove displaces the cam piece in the direction of both groove tracks. Each of the groove tracks end with a radially lifting ramp (17, 18) for extending the actuator pin from the axial groove. The radial lift of the exit ramps should be significantly smaller than the groove base depth of the axial groove between the exit ramps.

2 Claims, 1 Drawing Sheet

VALVE GEAR FOR AN INTERNAL COMBUSTION ENGINE

The invention relates to a valve train of an internal combustion engine, with a camshaft that comprises a carrier shaft and a cam part that is locked in rotation on this camshaft and can be displaced between two axial positions and has at least one group of cams with different cam lifts and an axial groove with two groove tracks that rise in opposite axial directions and whose axial lifts each correspond to the distance between two axial positions and are arranged completely one behind the other in the circumferential direction of the axial groove, and with an actuator pin that can be inserted into the axial groove for shifting the cam part in the direction of both groove tracks. For moving the actuator pin out from the axial groove, the groove tracks each end with a ramp that rises radially.

BACKGROUND

So-called sliding cam valve trains are known in numerous structural designs. To shift the cam part, the axially stationary actuator pin engages in the rotating axial groove whose axial lift forces the cam part to shift on the carrier shaft. In this way, the actuation of the gas exchange valves is switched between two adjacent cam lifts. The shifting of the cam part between the axial positions is performed within the angular range of the camshaft in which all of the cam lifts have no travel, i.e., at the proper time within the common reference circle phase of all cams. The time interval available for this constant angular range decreases with increasing engine speed and accordingly the insertion speed of the actuator pin into the axial groove must also be sufficiently high at high switching rotational speeds to shift the cam part without incorrect switching.

A valve train of the type specified above is known from DE 10 2009 009 080 A1. The two groove tracks do not run circumferentially next to each other, but instead completely one behind the other. This circumferential series connection of the groove tracks is indeed advantageous with respect to the axial installation space requirements of the cam part, but requires an especially quick actuator. This is because, in this case, two retraction processes of the actuator pin into the axial groove and two displacement processes of the cam part in the angle range of the common reference circle phase must be performed. The angle range available for inserting the actuator pin into the axial groove is small accordingly.

SUMMARY

The present invention is based on the objective of refining a valve train of the type named above so that the requirements on the actuator speed are as moderate as possible despite the circumferential series connection of the groove tracks.

This objective is achieved in that the radial lift of the extension ramps is significantly smaller than the groove base depth of the axial groove between the extension ramps. Differently than in the prior art cited above is that the extension ramp is not completely guided back to the height of the so-called high circle in that the axial groove is "cut in." Instead, the height of the extension ramp is large enough that the actuator pin is lifted sufficiently quickly and far enough to automatically leave the axial groove according to the displacement of the cam part. Through this relatively small height of the extension ramp, for the same ramp slope, its circumferential angle is also significantly smaller. Accordingly, the circumferential angle available in the axial groove for the insertion of the actuator pin is larger and the time interval needed for the insertion of the actuator pin can also be larger for the benefit of a less demanding actuator design.

In this respect, the actuator pin should be part of an electromagnetic actuator that inserts the actuator pin by means of electromagnetic force and against a restoring spring force into the axial groove, wherein the actuator is provided with an axial stop that holds the actuator pin between the extension ramps in an insertion position radially spaced apart from the groove base. With this relatively simple actuator design it is possible for the magnetic armature to remain on the axial stop after switching off the energization despite the restoring spring force. The reason for this is the remanence that is overcome, however, by the moving of the actuator pin onto the extension ramp according to the invention.

BRIEF DESCRIPTION OF THE DRAWINGS

Additional features of the invention can be found in the following description and from the drawings in which a valve train according to the invention is explained. If not specified otherwise, features or components that are identical or that have identical functions are provided with identical reference symbols. Shown are.

DETAILED DESCRIPTION OF THE PREFERRED EMBODIMENTS

Figure 5:
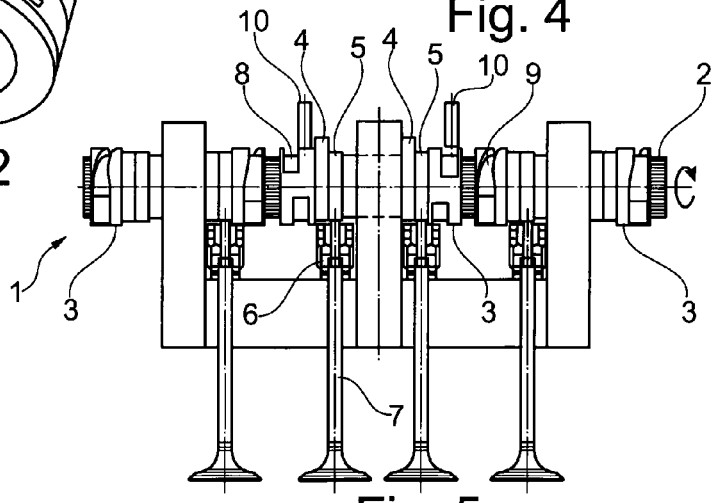

The invention will be explained starting with FIG. 5 that shows a variable stroke valve train of an internal combustion engine. The basic functional principle of this known valve train can be summarized in that a conventional, rigid camshaft is replaced by a camshaft 1 with a carrier shaft 2 with external teeth and cam parts 3 that are locked in rotation on this shaft by means of internal teeth and are arranged displaceable longitudinally. Each cam part has two groups of axially directly adjacent cams 4 and 5 whose different lifts are selectively transferred by means of cam followers, here by means of rolling finger followers 6, and transmitted to gas exchange valves 7.

The displacement of the cam part 3 required for the operating point-dependent activation of each cam 4 or 5 on the carrier shaft 2 is performed by means of two axial groove tracks 8 and 9 that run mirror symmetric at the two ends of the cam part and differ in their orientation according to a direction of displacement and in which, depending on the instantaneous axial position of the cam part, an actuator pin 10 of an electromagnetic actuator (not shown) is inserted. To stabilize the cam part in the two axial positions, a locking device (not shown here) is used that runs in the interior of the carrier shaft and locks in the interior of the cam part.

Figure 1:
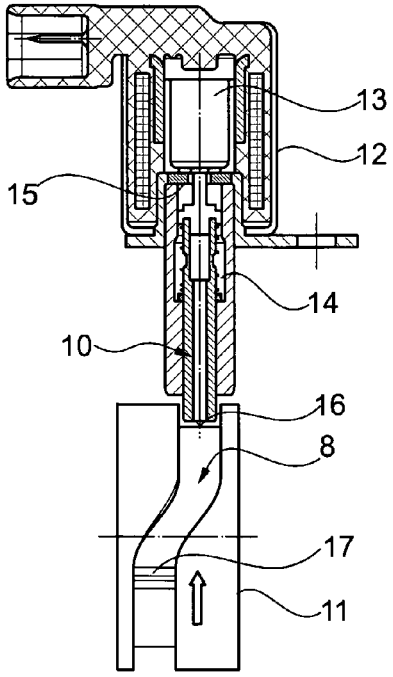
FIG. 1 a partial longitudinal section view of the axial groove with actuator pin of the valve train according to the invention inserted therein, FIG. 2 a perspective view of the axial groove according to FIG. 1, FIG. 3 a cross section of the axial groove according to FIGS. 1 and 2, FIG. 4 a cross section of a known axial groove, FIG. 5 a side view of a partial section of a known valve train.
Figure 2:
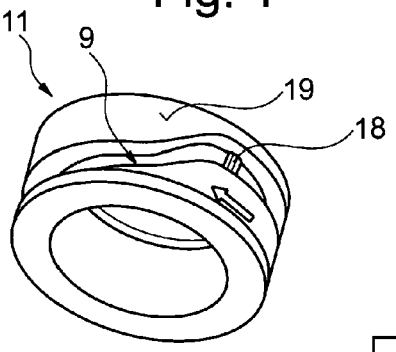

FIGS. 1 and 2 show an axial groove ring 11 according to the invention before its installation on a correspondingly constructed cam part (not shown) and an electromagnetic actuator 12 whose actuator pin 10 is inserted into the axial groove. Differently than in FIG. 5, the two groove tracks 8 and 9 do not run next to each other on the circumference of the cam part, but instead are completely one behind the other in series connection. The axial lift of each groove track 8, 9 is as large as the distance between two axial positions of the cam part, i.e., in the case of a valve train according to FIG. 5, as large as the center distance of the two cams 4 and 5.

When the actuator 12 is energized, the actuator pin 10 is actuated by a magnetic armature 13 and inserted against the force of a restoring spring 14 into the axial groove until the magnetic armature contacts an inner axial stop 15. In this completely inserted position, the actuator pin is spaced radially approximately 0.3 mm to the groove base. The run-out of the actuator pin from the axial groove rotating in the shown arrow direction is initiated by two ramps 17 and 18 that lift at the end of each groove track 8, 9 from the groove base radially only to approx. 0.8 mm (see FIG. 3). After the displacement process of the cam part 3, the actuator pin contacts the corresponding run-out ramp 17 or 18 and lifts the magnetic armature of the then deenergized actuator by 0.8 mm minus 0.3 mm=0.5 mm from the residually magnetized axial stop and leaves the axial groove due to the restoring spring force.

Figure 3:
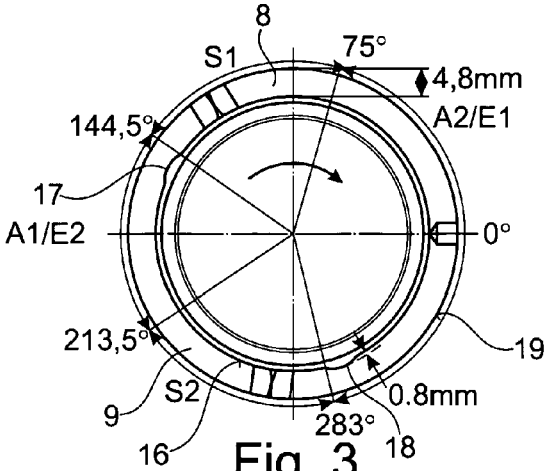
Figure 4:
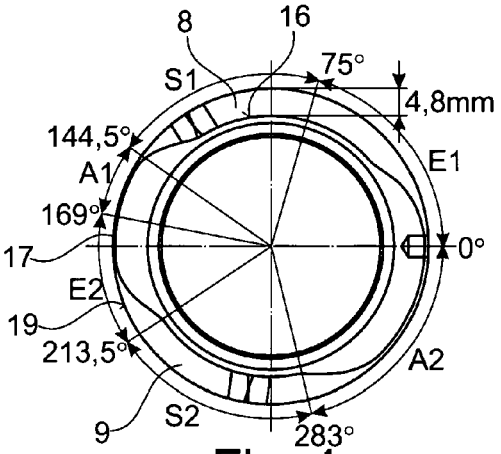

FIG. 3 shows the individual angle ranges of the axial groove according to the invention. References are the angle ranges shown in FIG. 4 of a known axial groove. The rotational direction of the axial grooves is shown in FIG. 3.

In the angle range between 283° and 75°, the axial groove has no axial lift, because in this range the cam lifts are active. The displacement area S1 of the first groove track 8 extends between 75° and 144.5° and the displacement area S2 of the second groove track 9 extends between 213.5° and 283°. In the known axial groove according to FIG. 4, a first run-out area A1 between 144.5° and 169° attaches to the first displacement area. The ramp 17 extending the actuator pin 10 out of the axial groove lifts radially by the entire groove base depth, i.e., starting from the groove base 16 by 4.8 mm up to the high circle 19 of the axial groove ring 11, so that the adjacent insertion area E2 of the second groove track 9 can begin only at 169°. Due to the run-out ramps 17, 18 of the axial groove according to the invention that are significantly smaller with 0.8 mm (compared with 4.8 mm) radial lift and also significantly shorter with respect to the circumferential angle here with approx. 35° overlap the run-out area A1 of the first groove track 8 and the insertion area E2 of the second groove track 9. In this case, the insertion area of the second groove track already begins at 144.5° (there the actuator pin is no longer blocked by the high circle on the insertion into the axial groove) and is thus 24.5° longer (169° compared with 144.5°) than in the known axial groove. Consequently, the insertion speed of the actuator 12 as a function of the maximum switching speed of the cam part 3 is slowed down by a time interval corresponding to this 24.5°.

The same applies qualitatively to the run-out area A2 of the second groove track 9/insertion area E1 of the first groove track 8. The run-out area of the second groove track extending in FIG. 4 between 283° and 0° and the insertion area of the first groove track extending between 0° and 75° merge according to the invention to a common run-in and run-out area A2/E1 between 283° and 75°. These angle ranges, however, are dominated by the cam lifts and relatively large, so that the numerical values explained above for the area of the first run-out ramp 17 are decisive for the required actuator speed.

LIST OF REFERENCE NUMBERS

1 Camshaft
2 Carrier shaft
3 Cam part
4 Cam
5 Cam
6 Cam follower/cam roller
7 Gas exchange valve
8 Groove track
9 Groove track
10 Actuator pin
11 Axial groove ring
12 Actuator
13 Magnetic armature
14 Restoring spring
15 Axial stop
16 Groove base
17 Run-out ramp
18 Run-out ramp
19 High circle

The invention claimed is:

1. A valve train of an internal combustion engine, comprising a camshaft that comprises a carrier shaft and a cam part that is locked in rotation on said shaft and is arranged displaceable between two axial positions and has at least one cam group with different cam lifts and an axial groove with two groove tracks that lift axially in opposite directions and having axial lifts that each correspond to a distance between the two axial positions and are arranged completely one behind the other in a circumferential direction of the axial groove, and an actuator pin that is insertable into the axial groove for displacing the cam part in a direction of both of the groove tracks, the groove tracks each end with a radially lifting ramp for extending the actuator pin from the axial groove, and a radial lift of the extension ramps is significantly smaller than a groove base depth of the axial groove between the exit ramps.

2. The valve train according to claim 1, wherein the actuator pin is part of an electromagnetic actuator that inserts the actuator pin by an electromagnetic force and against a restoring spring force into the axial groove, and the actuator is provided with an axial stop that holds the actuator pin between the exit ramps in an insertion position spaced radially from the groove base.

* * * * *